United States Patent [19]

Gundlach et al.

[11] Patent Number: 5,043,579

[45] Date of Patent: Aug. 27, 1991

[54] UNIFORM CHARGING DEVICE

[75] Inventors: Robert W. Gundlach, Victor; Richard F. Bergen, Ontario, both of N.Y.

[73] Assignee: Xerox Corporation, Stamford, Conn.

[21] Appl. No.: 544,573

[22] Filed: Jun. 27, 1990

[51] Int. Cl.[5] ..... H01T 19/04

[52] U.S. Cl. ..... 250/325; 361/230; 250/324

[58] Field of Search ..... 250/324, 325, 326; 361/230, 233

[56] References Cited

U.S. PATENT DOCUMENTS

| | | | |
|---|---|---|---|
| 2,836,725 | 5/1958 | Vyverberg | 250/49.5 |
| 2,879,395 | 3/1959 | Walkup | 250/49.5 |
| 3,711,710 | 1/1973 | Wright | 250/49.5 |
| 3,717,801 | 2/1973 | Silverberg | 317/262 |
| 3,813,547 | 5/1974 | Silverberg | 250/324 |
| 3,937,960 | 2/1976 | Matsumato et al. | 250/326 |
| 4,153,836 | 8/1979 | Simm | 250/325 |
| 4,425,035 | 1/1984 | Tarumi et al. | 250/324 |
| 4,426,654 | 1/1984 | Tarumi et al. | 250/326 |
| 4,700,261 | 10/1987 | Nagese et al. | 361/225 |
| 4,785,372 | 11/1988 | Hosono et al. | 366/225 |
| 4,963,738 | 10/1990 | Gandlach et al. | 250/325 |

*Primary Examiner*—Bruce C. Anderson

[57] ABSTRACT

A scorotron like charging device includes an ion generator from which ion flow is controlled by fringe fields developed along an edge of an electrode sandwich located near the ion source.

7 Claims, 3 Drawing Sheets

UNIFORM CHARGING DEVICE

FIELD OF THE INVENTION

The present invention relates to a charging device for depositing charge on an adjacent surface. More particularly, it is directed to a corotron-like corona charging arrangement that also acts as a scorotron, which will hereinafter be referred to as a coroscorotron. The device is usable in a xerographic reproduction system for generating a flow of ions onto an adjacent imaging surface for altering or charging the electrostatic charge thereon.

BACKGROUND OF THE INVENTION

In the electrophotographic reproducing arts, it is necessary to deposit a uniform electrostatic charge on an imaging surface, which charge is subsequently selectively dissipated by exposure to an information containing optical image to form an electrostatic latent image. The electrostatic latent image may then be developed and the developed image transferred to a support surface to form a final copy of the original document.

In addition to precharging the imaging surface of a xerographic system prior to exposure, corona devices are used to perform a variety of other functions in the xerographic process. For example, corona devices aid in the transfer of an electrostatic toner image from a reusable photoreceptor to a transfer member, the tacking and detacking of paper to the imaging member, the conditioning of the imaging surface prior to, during, and after the deposition of toner thereon to improve the quality of the xerographic copy produced thereby.

Both D.C. and A.C. type corona devices are used to perform many of the above functions.

The conventional form of corona discharge device for use in reproduction systems of the above type is shown generally in U.S. Pat. No. 2,836,725 in which a conductive corona electrode in the form of an elongated wire is connected to a corona generating D.C. voltage. The wire is partially surrounded by a conductive shield which is usually electrically grounded. The surface to be charged is spaced from the wire on the side opposite the shield and is mounted on a grounded substrate. Alternately, a corona device of the above type may be biased in a manner taught in U.S. Pat. No. 2,879,395 wherein an A.C. corona generating potential is applied to the conductive wire electrode and a D.C. potential is applied to the conductive shield partially surrounding the electrode to regulate the flow of ions from the electrode to the surface to be charged. Other biasing arrangements are known in the prior art and will not be discussed in great detail herein.

There have been charging devices that display some of the qualities of both a corotron and a scorotron. A reference screen or series of wires each having a relatively large opening to allow the coronode to initially "see" the receiver unobscured, has also been used. This opening provides the corotron feature and the wire screen provides the scorotron feature. Generally, these devices operate with grounded shields and therefore are quite inefficient.

Various approaches to answering these problems have been tried in the past. For example, U.S. Pat. No. 3,717,801 discloses a shieldless corona device having a plurality of coronodes which together discharge a corona current onto a conductive receiving surface. A multiple coronode corona device uses a ground plane mounted underneath the receiving medium to absorb and dissipate any wayward charging effects. U.S. Pat. No. 3,937,960 is directed to a corona charging device for an electrophotographic reproduction machine which uses a flexible conductive control plate, adjustably mounted above a coronode discharging wire, to vary the electric field strength generated by corona discharging electrode during charging of conductive surface. U.S. Pat. No. 3,711,710 discloses a corona charging system wherein a corona point electrode, protruding from a planar conductive shield plate, delivers a discharging current to an electrographic recording member. An adjustably mounted conductive shield plate not only shields the discharge of a corona point electrode, but also controls the charge accumulated on a dielectric surface by translating a vertical degree of freedom about the long corona electrode. U.S. Pat. No. 3,813,547 shows a corona generating device comprising a coronode which discharges an ion current flow onto a photoreceptror surface. An ion current flow is regulated and shielded by a single conductive substrate which is mounted above a coronode wire. U.S. Pat. Nos. 4,700,261 and 4,785,372 disclose dual electrode corona charging devices which together project an ion flow onto a charge receiving surface. Although these attempts at solving the above-mentioned charging problem have had some success, they have not been entirely satisfactory.

SUMMARY OF THE INVENTION

Accordingly, a hybrid coroscorotron is disclosed that employs a coronode which discharges an ion charging current onto a photoreceptor surface and is spaced above an overhanging ruthenium oxide coated upper electrode and a lower copper reference electrode plate which doubles as a shield. More specifically, a coroscorotron is disclosed which abandons the conventional shield structure for a pair of conductive electrodes on an insulating plate which is mounted underneath and in overhanging fashion with respect to the ion discharging electrode to redirect discharging ions onto a photoreceptor surface.

BRIEF DESCRIPTION OF THE DRAWINGS

The foregoing and other features of the instant invention will be more apparent from a further reading of the specification, claims and from the drawings in which:

DETAILED DESCRIPTION OF THE DRAWINGS

Figure 1:
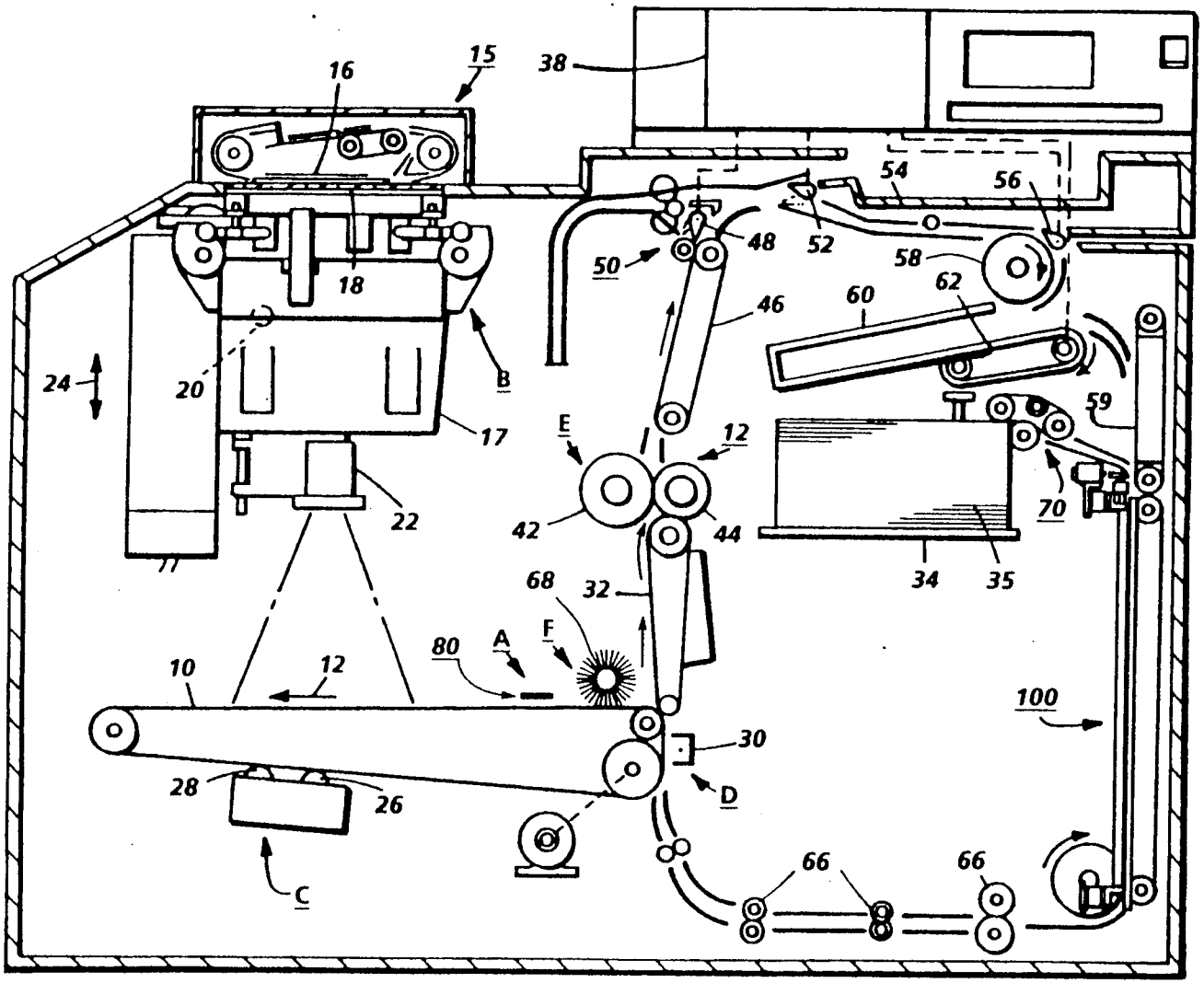
FIG. 1 is a schematic elevational view showing an electrophotographic copier employing the features of an aspect of the present invention.

For a general understanding of the features of the present invention, reference is had to the drawings. In the drawings, like reference numerals have been used throughout to designate identical elements. FIG. 1 schematically depicts the various components of an illustrative electrophotographic copying machine incorporating the improved coroscorotron apparatus of the present invention therein.

Inasmuch as the art of electrophotographic copying is well known, the various processing stations employed in the FIG. 1 copying machine will be shown hereinafter schematically and their operation described briefly with reference thereto.

As shown in FIG. 1, the illustrative electrophotographic printing machine employs a belt 10 having a photoconductive surface thereon. Preferably, the photoconductive surface is made from a selenium alloy. Belt 10 moves in the direction of arrow 12 to advance successive portions of the photoconductive surface through the various processing stations disposed about the path of movement thereof.

Initially, a portion of the photoconductive surface passes through charging station A. At charging station A, a corona generating device in accordance with the present invention, indicated generally by the reference numeral 80, charges the photoconductive surface to a relatively high substantially uniform potential.

Next, the charged portion of the photoconductive surface is advanced through imaging station B. At imaging station B, a document handling unit indicated generally by the reference numeral 15, positions original document 16 facedown over exposure system 17. The exposure system, indicated generally by reference numeral 17 includes lamp 20 which illuminates document 16 positioned on transparent platen 18. The light rays reflected from document 16 are transmitted through lens 22. Lens 22 focuses the light image of original document 16 onto the charged portion of the photoconductive surface of belt 10 to selectively dissipate the charge thereof. This records an electrostatic latent image on the photoconductive surface which corresponds to the information areas contained within the original document. Thereafter, belt 10 advances the electrostatic latent image recorded on the photoconductive surface to development station C. Platen 18 is mounted movably and arranged to move in the direction of arrows 24 to adjust the magnification of the original document being reproduced. Lens 22 moves in synchronism therewith so as to focus the light image of original document 16 onto the charged portions of the photoconductive surface of belt 10.

Document handling unit 15 sequentially feeds documents from a stack of documents placed by the operator in a normal forward collated order in a document stacking and holding tray. The documents are fed from the holding tray in seriatim, to platen 18. The document handling unit recirculates documents back to the stack supported on the tray. Preferably, the document handling unit is adapted to serially sequentially feed the documents, which may be of various sizes and weights of paper or plastic containing information to be copied. The size of the original document disposed in the holding tray and the size of the copy sheet are measured.

While a document handling unit has been described, one skilled in the art will appreciate that the size of the original document may be measured at the platen rather than in the document handling unit. This is required for a copying or printing machine which does not include a document handling unit, or when one is making copies of A3 or 11"×17" documents where the document handler has to be raised up from the platen and the oversized document manually placed on the platen for copying.

With continued reference to FIG. 1, at development station C, a pair of magnetic brush developer rollers, indicated generally by the reference numerals 26 and 28, advance a developer material into contact with the electrostatic latent image. The latent image attracts toner particles from the carrier granules of the developer material to form a toner powder image on the photoconductive surface of belt 10.

After the electrostatic latent image recorded on the photoconductive surface of belt 10 is developed, belt 10 advances the toner powder image to transfer station D. At transfer station D, a copy sheet is moved into contact with the toner powder image. Transfer station D includes a corona generating device 30 which sprays ions onto the backside of the copy sheet. This attracts the toner powder image from the photoconductive surface of belt 10 to the sheet. After transfer, conveyor 32 advances the sheet to fusing station E.

The copy sheets are fed from tray 34 to transfer station D. The tray senses the size of the copy sheets and sends an electrical signal indicative thereof to a microprocessor within controller 38. Similarly, the holding tray of document handling unit 15 includes switches thereon which detect the size of the original document and generate and electrical signal indicative thereof which is transmitted also to a microprocessor controller 38.

Fusing station E includes a fuser assembly, indicated generally by the reference numeral 40, which permanently affixes the transferred powder image to the copy sheet. Preferably, fuser assembly 40 includes a heated fuser roller 42 and backup roller 44. The sheet passes between fuser roller 42 and backup roller 44 with the powder image contacting fuser roller 42. In this manner, the powder image is permanently affixed to the sheet.

After fusing, conveyor 46 transports the sheets to gate 48 which functions as an inverter selector. Depending upon the position of gate 48, the copy sheets will either be deflected into a sheet inverter 50 or bypass sheet inverter 50 and be fed directly onto a second decision gate 52. Thus, copy sheets which bypass inverter 50 turn a 90° corner in the sheet path before reaching gate 52. Gate 48 directs the sheets into a face up orientation so that the imaged side which has been transferred and fused is face up. If inverter path 50 is selected, the opposite is true, i.e., the last printed face is facedown. Second decision gate 52 deflects the sheet directly into an output tray 54 or deflects the sheet into a transport path which carriers it on without inversion to a third decision gate 56. Gate 56 either passes the sheets directly on without inversion into the output path of the copier, or deflects the sheets into a duplex inverter roll transport 58. Inverting transport 58 inverts and stacks the sheets to be duplexed in a duplex tray 60 when gate 56 so directs. Duplex tray 60 provides intermediate or buffer storage for those sheets which have been printed on one side and on which an image will be subsequently printed on the side opposed thereto, i.e., the copy sheets being duplexed. Due to the sheet inverting by rollers 58, these buffer set sheets are stacked in duplex tray 60 facedown. They are stacked in duplex tray 60 on top of one another in the order in which they are copied.

In order to complete duplex copying, the previously simplexed sheets in tray 60 are fed to conveyor 59 seriatim by bottom feeder 62 back to transfer station D for transfer of the toner powder image to the opposed side of the sheet. Conveyors 100 and 66 advance the sheet along a path which produces an inversion thereof. However, inasmuch as the bottommost sheet is fed from duplex tray 60, the proper or clean side of the copy sheet is positioned in contact with belt 10 at transfer station D so that the toner powder image thereon is transferred thereto. The duplex sheets are then fed through the same path as the previously simplexed sheets to be stacked in tray 54 for subsequent removal by the printing machine operator.

Returning now to the operation of the printing machine, invariably after the copy sheet is separated from the photoconductive surface of belt 10, some residual particles remain adhering to belt 10. These residual particles are removed from the photoconductive surface thereof at cleaning station F. Cleaning station F includes a rotatably mounted fibrous brush 68 in contact with photoconductive surface of belt 10. These particles are cleaned from the photoconductive surface of belt 10 by the rotation of brush 68 in contact therewith. Subsequent to cleaning, a discharge lamp (not shown) floods the photoconductive surface with light to dissipate any residual electrostatic charge remaining thereon prior to the charging thereof for the next successive imageing cycle.

Figure 2:
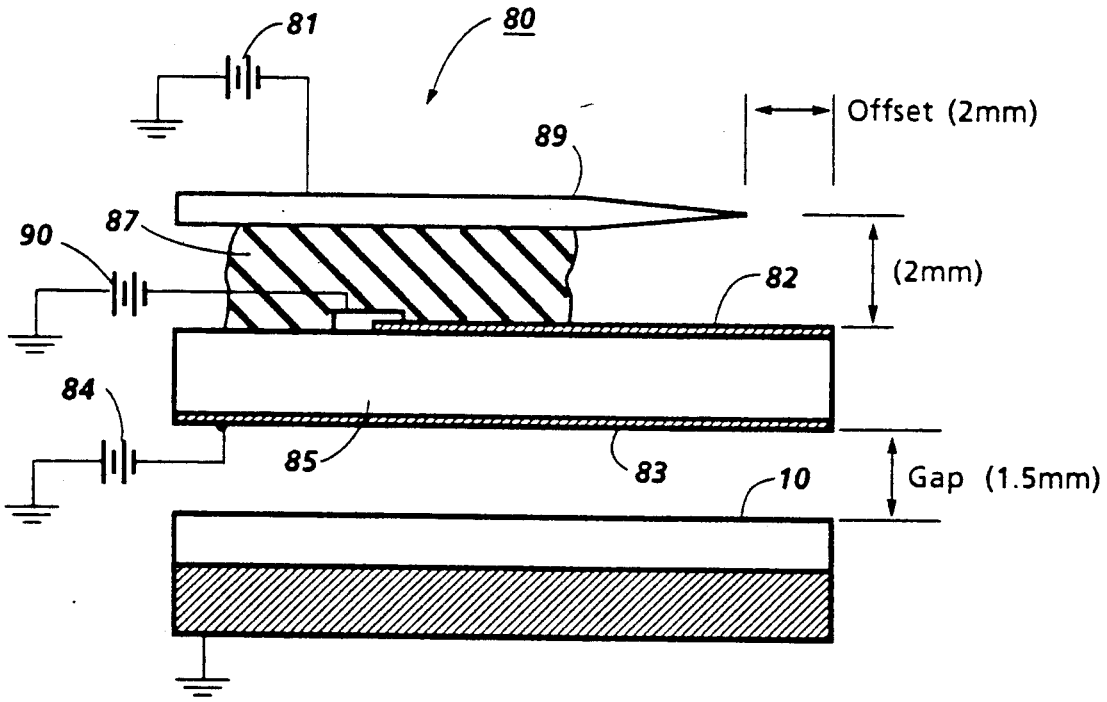
FIG. 2 shows a side view of the coroscorotron device of FIG. 1 and the present invention employed as the charging unit.
Figure 3:
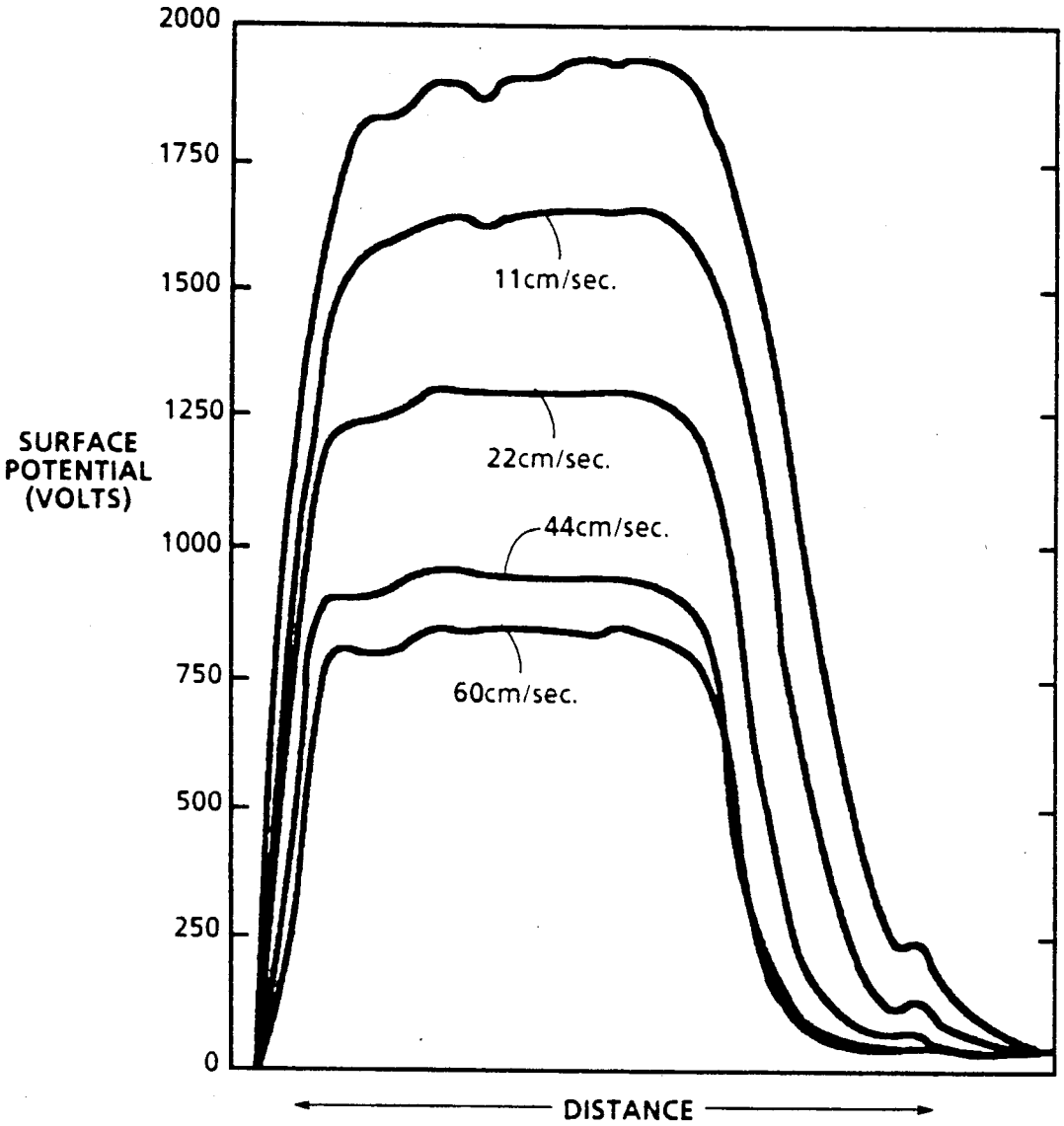
FIG. 3 is a chart showing the charge obtained with the device of the present invention at various charging speeds in centimeters per second.

Turning now to an aspect of the present invention, and in reference to FIGS. 2 and 3, coroscorotron 80 is positioned in a horizontal plane and comprises a coronode in the form of corona needles 89 connected to a high voltage DC at 81 of, e.g., 5000 V, and is positioned by insulating member 87 about 2 mm above an upper electrode 82, which is connected to DC power source 90, and is comprised of a coating of ruthenium oxide in a glass binder, and a copper reference electrode 83 that is connected to a voltage source 84. Ruthenium oxide coated upper electrode 82 is separated from copper electrode 83 by a 0.63 mm thick Alumina member 85. The purpose of the ruthenium oxide glass coated electrode 82 is to provide the ion-pumping fringe fields; the surface resistivity of the "pumping" electrode must be high enough to prevent arcing from the high voltage coronode closely spaced from it. The preferred range of surface resistivity for this electrode has been found to be between $10^7$ and $10^{10}$ ohms/square. Electrode 83 is separated from the upper surface of a biased photoconductor 10 by about 1.5 mm. Critically, corona needles 89 are spaced about 2 mm away from the upper surface of electrode 82 as well as offset laterally about 2 mm in from the edge of driving electrode 83 that forms fringing fields driving the ions emitted by the coronode toward photoconductor 10. With this novel charging method and apparatus, coronode 89, which could take many forms, e.g., pins, sawteeth, etc., emit ions which are then controlled by fringe fields developed at the edge of a sandwich formed by electrode 82, insulating spacer member 85 and electrode 83 located between the ion source and the charge receiver. In cases of positive charging, the coronode is preferably in the form of a wire or edge of a blade. While not a true scorotron in that the charging voltage is not strictly asymptotic, coroscorotron 80 exhibits high charging efficiency and considerable leveling or uniformity as evidenced by the graph in FIG. 3.

In reference to the graph shown in FIG. 3, it shows that the device of the present invention is operated in scorotron fashion, that is, a controllable voltage is applied to an insulating receiver. FIG. 3 shows electrometer traces of surface potential, scanned orthogonal to the motion of the charge receiving insulator, after charging at the speeds indicated. Since the charges are derived from the corona emitting needle tips spaced 3 mm on center, and a relatively uniform surface potential is shown for each processed speed, a levelling function is confirmed.

FIG. 2 illustrates a plane of corona emitting needles 89, spaced about 3 mm on center and mounted about 2 mm from a parallel driving electrode 82 of low conductivity, non corosive film of ruthenium oxide or the like, supported on a robust insulating substrate of alumina or the like with a coating on the lower surface acting as a reference electrode. A potential of about −5 kV is applied to the row of corona emitting needles, while a reference potential of −500 V or so is applied to the control electrode 83, and a driving potential of about −1000 V is applied to the ruthenium electrode 82. For efficient, controlled charging, this lower electrode 83 should be supported about 2.0 mm from the charge receiving surface 10.

It should now be apparent that a novel charging device is disclosed in which the coronode is mounted above and near the edge of sandwich electrodes attached to a supporting dielectric member. This charging unit can be positioned relative to a screen in several ways to form scorotron type devices. The essential and distinguishing feature of this concept is that a "plate" is being used as a shield and reference electrode, whereby the plate may partially block a direct path from the coronode to the receiver. The plate's edge provides fringe fields to pump ions to a receiver. Pin coronodes have produced similar results with the conductive reference electrode 83 being 2 mils thick.

While this invention has been described with reference to the structures disclosed herein, they are not confined to the details as set forth and are intended to cover modifications and changes that may come within the scope of the following claims.

What is claimed is:

1. A charging system to apply a uniform charge to a charge retentive surface, comprising:

a charge retentive surface;

corona producing means;

high voltage means connected to said corona producing means to apply sufficient voltage to said corona producing means that corona ions are emitted from said corona producing means;

a dielectric support substrate having an upper and lower surface;

a high resistivity strip driving electrode means coated onto the upper surface of and extending to an edge of said dielectric support substrate; and a conductive reference electrode positioned on and extending to an edge of the lower surface of said dielectric support substrate, and wherein said dielectric support substrate extends beyond a corona producing edge of said corona producing means.

2. The charging system of claim 1, wherein said high resistivity strip driving electrode means and said reference electrode are integral with said dielectric support substrate.

3. The charging system of claim 2, wherein a voltage is applied to said high resistivity strip driving electrode means.

4. The charging system of claim 3, wherein said reference electrode has a DC voltage applied thereto.

5. The charging system of claim 1, wherein said high resistivity strip driving electrode means is comprised of ruthenium oxide glass having a surface resistivity of about $10^7$ and $10^{10}$ ohms/square.

6. The charging system of claim 1, wherein a potential difference between said high resistivity strip driving electrode means and said reference electrode produces fringe fields at the edge of said dielectric support substrate to drive ions to said charge retentive surface.

7. The charging system of claim 6, wherein said high resistivity strip driving electrode means is connected to ground, and acquires a voltage at the fringe field edge resulting from the product of ion current and surface resistance to ground.

* * * * *